US006988934B1

(12) United States Patent
Lee et al.

(10) Patent No.: US 6,988,934 B1
(45) **Date of Patent: *Jan. 24, 2006**

(54) METHOD AND APPARATUS OF A VARIABLE HEIGHT AND CONTROLLED FLUID FLOW PLATEN IN A CHEMICAL MECHANICAL POLISHING SYSTEM

(75) Inventors: Gregory C. Lee, Belmont, CA (US); Simon McClatchie, Fremont, CA (US); John M. Boyd, Atascadero, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/674,319

(22) Filed: Sep. 29, 2003

Related U.S. Application Data

(63) Continuation-in-part of application No. 09/747,828, filed on Dec. 21, 2000, now Pat. No. 6,776,695.

(51) Int. Cl.
*B24B 1/00* (2006.01)

(52) U.S. Cl. ..... 451/11; 451/296; 451/300; 451/303; 451/306; 451/398

(58) Field of Classification Search ..... 451/41, 451/285, 398, 397, 173, 168, 387, 388, 283, 451/286, 296, 300, 303, 11

See application file for complete search history.

(56) References Cited

U.S. PATENT DOCUMENTS

| | | | | |
|---|---|---|---|---|
| 5,695,392 | A * | 12/1997 | Kim | 451/288 |
| 5,800,248 | A * | 9/1998 | Pant et al. | 451/41 |
| 5,916,012 | A * | 6/1999 | Pant et al. | 451/41 |
| 5,961,372 | A * | 10/1999 | Shendon | 451/41 |
| 5,980,368 | A * | 11/1999 | Chang et al. | 451/303 |
| 6,126,527 | A * | 10/2000 | Kao et al. | 451/307 |
| 6,135,859 | A * | 10/2000 | Tietz | 451/41 |
| 6,183,350 | B1 * | 2/2001 | Lin et al. | 451/41 |
| 6,234,878 | B1 * | 5/2001 | Moore | 451/41 |
| 6,235,858 | B1 * | 5/2001 | Swarup et al. | 526/301 |
| 6,491,570 | B1 * | 12/2002 | Sommer et al. | 451/41 |
| 6,607,425 | B1 * | 8/2003 | Kistler et al. | 451/41 |
| 6,656,024 | B1 * | 12/2003 | Boyd et al. | 451/41 |

* cited by examiner

*Primary Examiner*—George Nguyen
(74) *Attorney, Agent, or Firm*—Martine Penilla & Gencarella, LLP

(57) ABSTRACT

An apparatus for use in a chemical mechanical planarization (CMP) system is provided. The apparatus includes a platen capable of introducing fluid beneath a polishing pad and a platen support cover configured to surround the platen. The platen is disposed at a first level and the platen support cover is disposed at a second level, the first level being lower relative to the second level. Both the platen and the platen support cover are configured to be disposed below the polishing pad such that the polishing pad is closer to the second level than the first level. The platen support cover has a width at the second level that is substantially equal around the platen. An apparatus and method for controlling pressure beneath a polishing pad is also provided.

21 Claims, 14 Drawing Sheets

METHOD AND APPARATUS OF A VARIABLE HEIGHT AND CONTROLLED FLUID FLOW PLATEN IN A CHEMICAL MECHANICAL POLISHING SYSTEM

CROSS REFERENCE TO RELATED APPLICATIONS

This application claims priority under 35 U.S.C. § 120 as a continuation-in-part of U.S. patent application Ser. No. 09/747,828, now U.S. Pat. No. 6,776,695, entitled "PLATEN DESIGN FOR IMPROVING EDGE PERFORMANCE IN CMP APPLICATIONS," and filed on Dec. 21, 2000. The disclosure of this patent application is incorporated herein by reference.

BACKGROUND OF THE INVENTION

1. Field of the Invention

This invention relates generally to chemical mechanical planarization apparatuses, and more particularly to methods and apparatuses for improved edge performance in chemical mechanical polishing applications by controlling airflow beneath a substrate.

2. Description of the Related Art

In the fabrication of semiconductor devices, there is a need to perform Chemical Mechanical Planarization (CMP) operations, including polishing, buffing and substrate cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to variations in the surface topography. In other applications, metallization line patterns are formed in the dielectric material, and then metal CMP operations are performed to remove excess metallization. Further applications include planarization of dielectric films deposited prior to the metallization process, such as dielectrics used for shallow trench isolation of poly-metal features.

Typically CMP systems implement a belt, orbital or brush operation in which belts, pads, or brushes are used to scrub, buff, and polish one or both sides of substrate. The pad itself is typically made of polyurethane material or other suitable material and may be backed by a supporting belt, for example a stainless steel belt. In operation a slurry material is applied to and spread across the surface of the polishing pad or belt. As the belt or pad covered in slurry rotates, a substrate is lowered to the surface of the pad and is polished.

FIG. 1 illustrates an exemplary prior art CMP system 10. The CMP system 10 in FIG. 1 is a belt-type system, utilizing a polishing pad 18 mounted on two drums 24 which drive the polishing pad 18 in a rotational motion as indicated by rotation directional arrows 26. A substrate 12 is mounted on a carrier head 14, which is rotated in direction 16. The rotating substrate 12 is then applied against the polishing pad 18 with a force to accomplish a CMP process. Some CMP processes require significant force F to be applied. A platen 50 is provided to stabilize the polishing pad 18 and to provide a solid surface onto which to apply the substrate 12.

Slurry 28 composing of an aqueous solution such as NH4OH or DI water containing dispersed abrasive particles is introduced upstream of the substrate 12. The process of scrubbing, buffing and polishing of the surface is achieved by using the polishing pad 18. Typically, the polishing pad 18 is composed of porous or nonporous or fibrous materials and lacks fix abrasives. The polishing pad is grooved for slurry transportation under the substrate. The polishing pad 18 contains grooves and micropores that transport slurry 28 under the substrate 12 to be polished.

FIG. 2A provides a cross sectional view of the prior art CMP system 10 discussed in FIG. 1 above. The carrier head 14 may contain a retaining ring 32 that surrounds and retains the substrate 12 during processing. Air pressure supplied through the platen 50 provides support to the back of the polishing pad 18.

FIG. 2B is a detailed view of a conventional platen configuration 80. The illustration provides a top view of the polishing pad 18 and the platen 50 positioned below the carrier head as seen in FIG. 1. Often, the platen 50 includes air holes 55 to provide upward air pressure to support the polishing pad 18 which rotates beneath the surface of the substrate being polished. In prior art platen design, air escapes 118 allow air to uncontrollably and randomly and non-uniformly leak over different surface regions defined between the area above the platen and below the polishing pad 18. In the case of 300 mm or larger wafers, non-uniformity of air pressure from uncontrollable leakage is more noticeable due to the larger platen diameter relative to the polishing pad 18 width. The air escapes 118 being of varying length shown in FIG. 2 note that air escapes 118 perpendicular to the polishing pad 18 implemented in a belt format is of shorter distance than at other angles (e.g., 45 degrees) allowing greater flow in the regions of shorter distance. Although several straight lines are illustrated to show some paths that the air can randomly escape over the surface of the platen cover 22, it should be understood that air can escape from the platen 50 and over the platen cover 22 at any location around the periphery of the platen 50.

In summary, non-uniform leakage of fluid beneath the polishing pad 18 provides an uneven polishing surface for the substrate creating an undesirable non-uniform removal. Uncontrolled leakage of air supplied to the backside of the polishing pad 18 on CMP systems creates an additional burden of greater facility requirements and higher operational cost.

There is a need therefore for a platen design that provides uniform pressure beneath the polishing surface by uniformly distributing and otherwise controlling fluid escape.

SUMMARY OF THE INVENTION

Broadly speaking, the present invention provides apparatuses and methods for enabling control of pressure beneath a polishing pad in a Chemical Mechanical Planarization (CMP) system. It should be appreciated that the present invention can be implemented in numerous ways, including as an apparatus, a system, a device, or a method. Several inventive embodiments of the present invention are described below.

In accordance with one embodiment of the present invention an apparatus for use in a chemical mechanical planarization (CMP) system is provided. The apparatus includes a platen capable of introducing fluid beneath a polishing pad and also includes a platen support cover configured to surround the platen. The platen is disposed at a first level and the platen support cover is disposed at a second level, the first level being lower relative to the second level. Both the platen and the platen support cover are configured to be disposed below the polishing pad such that the polishing pad is closer to the second level than the first level the platen support cover. The platen support cover has a width at the second level that is substantially equal around the platen.

In accordance with another embodiment of the present invention an apparatus for use in a chemical mechanical planarization (CMP) system is provided. The system includes a platen and a platen support cover configured to surround the platen. The platen is disposed at a first level and the platen support cover being disposed at a second level, the first level being lower relative to the second level. The platen and the platen support cover are configured to be disposed below a polishing pad such that the polishing pad is closer to the second level than the first level. At least one fluid output control path may be defined through the platen support cover at a wall location defined between the first level and the second level. The at least one fluid output control path is capable of enabling controlled release of fluid contained over the platen, surrounded by the platen support cover, and beneath the polishing pad.

In accordance with another embodiment of the present invention a method for controlling pressure beneath a polishing pad is provided. The method begins as a fluid volume is defined under the polishing pad at a location where a substrate is to be applied over the polishing pad. The method then provides for controlling output of a fluid from the fluid volume when the substrate is applied over the polishing pad.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

FIG. 4A-1 is a top view diagram of a recessed platen with circular support containing fluid output control paths, in accordance with one embodiment of the present invention.

FIG. 4A-2 is a cross sectional diagram of a recessed platen with circular support containing fluid output control paths, in accordance with one embodiment of the present invention.

FIG. 4A-3 is a cross sectional frontal view of a platen support cover containing fluid output control paths that are trenched in the surface, in accordance with one embodiment of the present invention.

FIGS. 4C1–4C3 are several diagrams of a recessed platen designs containing fluid output control paths, in accordance with one embodiment of the present invention.

DETAILED DESCRIPTION OF THE INVENTION

Several exemplary embodiments of the invention will now be described in detail with reference to the accompanying drawings. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 3:
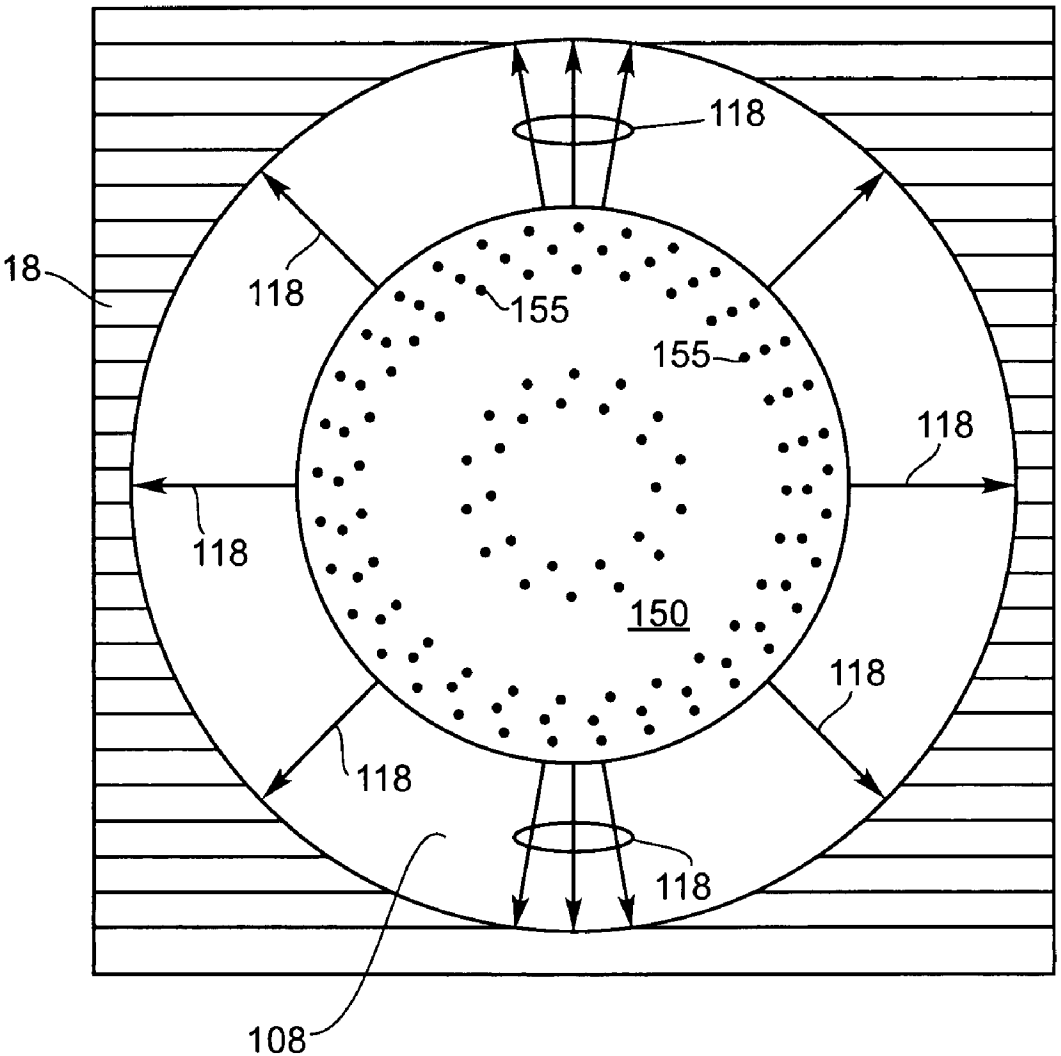
FIG. 3 is a top view diagram of a platen with circular support for uniform fluid distribution, in accordance with one embodiment of the present invention.

FIG. 3 is a top view diagram of an apparatus for use on a chemical mechanical planarization (CMP) system. Polishing or planarization of a substrate includes material removal on the surface of the substrate such that a level of planarity is achieved. To one skilled in the art, planarization includes polishing, buffing and substrate cleaning. Accordingly, as used herein, the terms Chemical Mechanical Polishing and Chemical Mechanical Planarization may be interchangeably used to describe the process by which a substrate is applied to the polishing surface such that friction is applied to the substrate for the purpose of removing material, planarizing, or polishing. A platen 150 is disposed beneath a polishing pad 18 and surrounded by a platen support cover 108. The platen 150 is configured to introduce fluid beneath the polishing pad 18. In one embodiment, the fluid is air that is supplied from facilities of a clean room, or the like. Other suitable fluids may also be used. In this example, the platen 150 is disposed at a first level and the platen support cover 108 is disposed at a second level. In one orientation, the first level is disposed lower relative to the second level. In this manner, the platen 150 will sit in a recessed orientation relative to the support cover. The platen 150 and the platen support cover 108 are configured to be disposed below the polishing pad 18 such that the polishing pad 18 is closer to the second level than the first level. As herein described, the first level and second level refer to the height of the platen 150 and the platen support cover 108, respectively relative to the polishing pad 18. The platen 150 is disposed at a level below that of the platen support cover 108 such that the polishing pad 18 is closer to the platen support cover 108 than the platen 150.

Figure 2A:
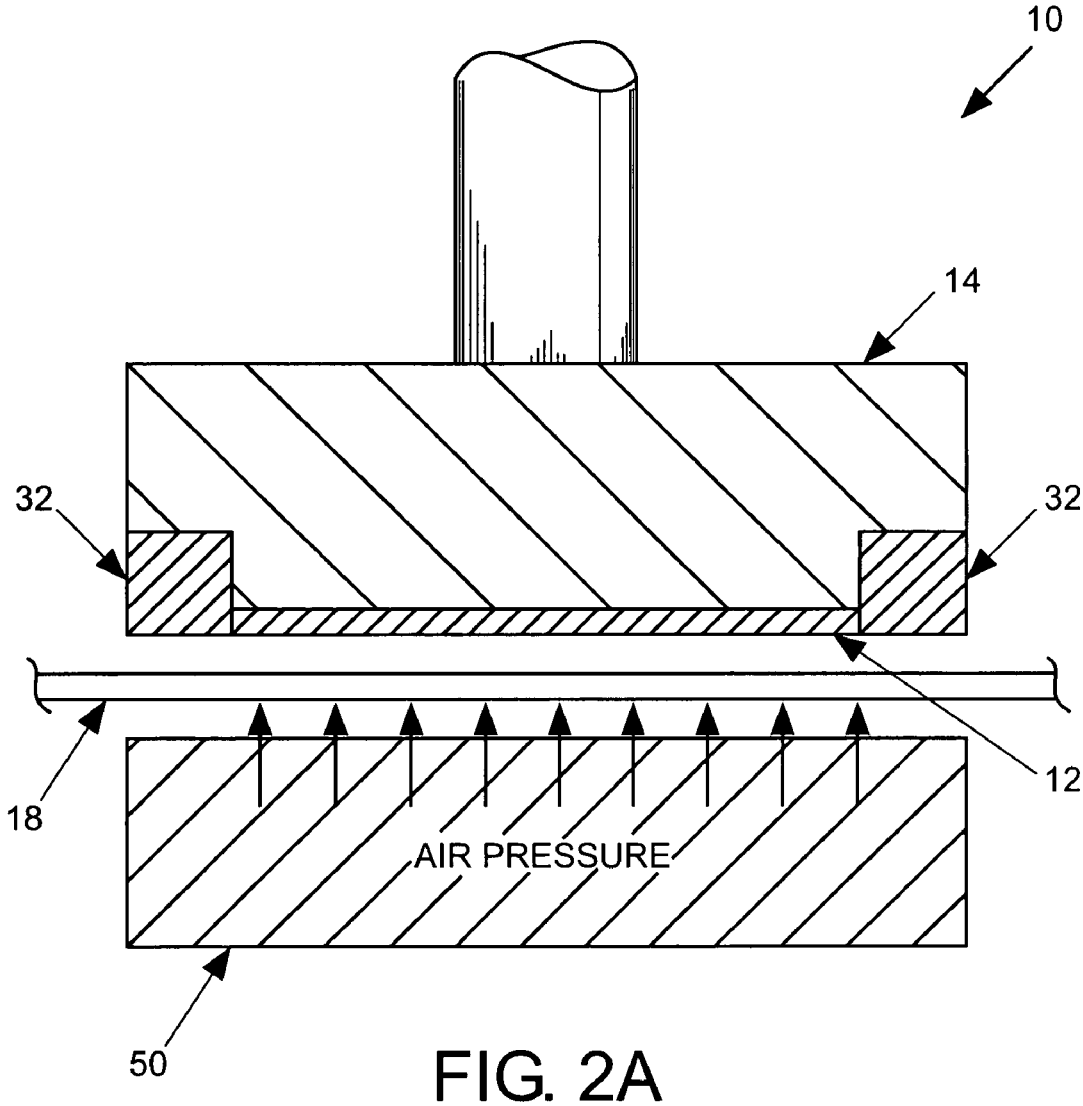
FIG. 2A (Prior Art)
FIG. 2A provides a cross sectional view of the prior art CMP system.
Figure 2B:
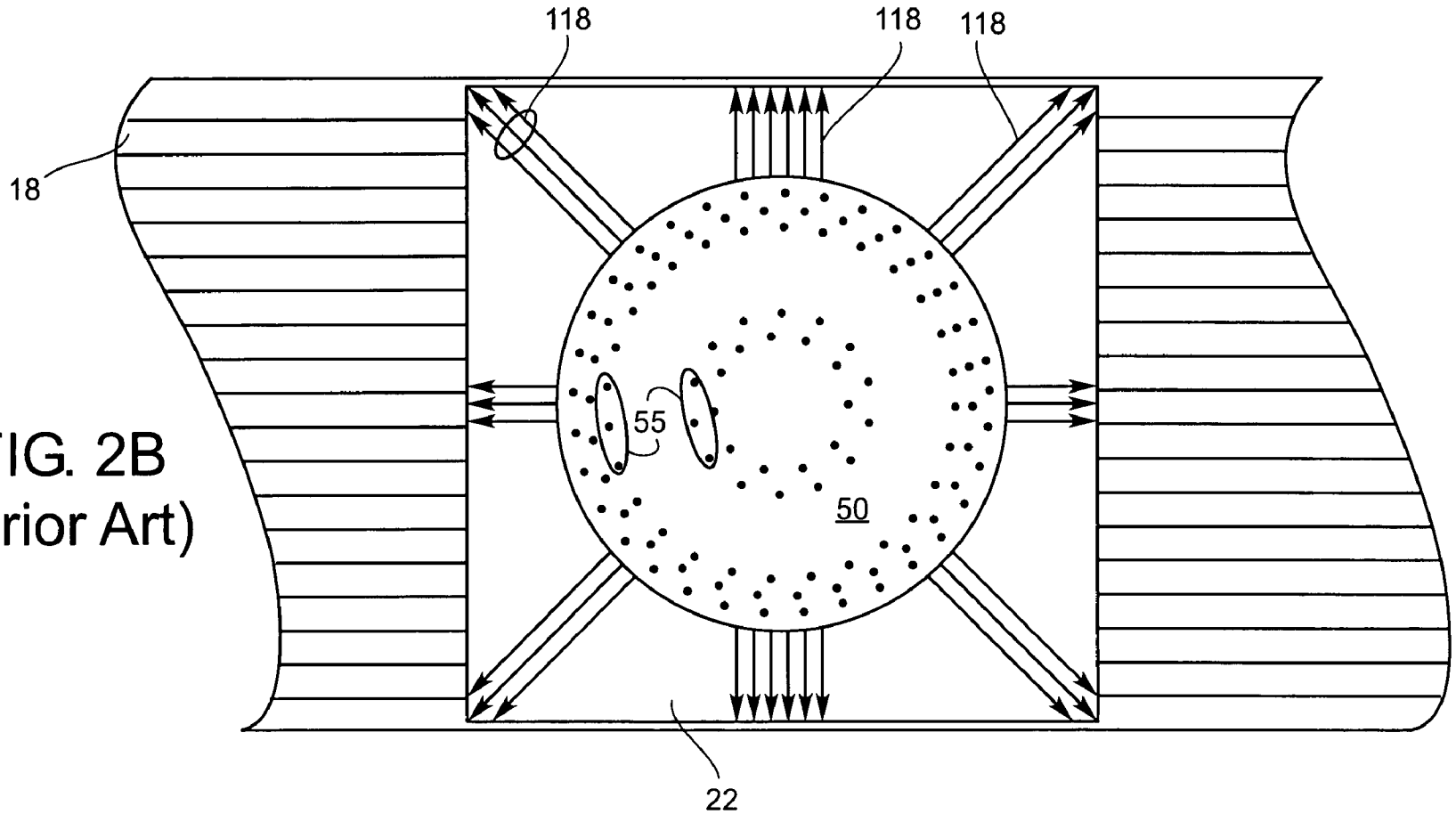
FIG. 2B (Prior Art)
FIG. 2B is a top view diagram of a typical prior art platen design.

The platen support cover 108 has a width at the second level, that is substantially equal around the platen 150. The platform support cover 108 having a substantially equal width provides uniform distribution of fluid pressure escaping beneath the polishing pad 18, and pictorially shown as air escape paths 118. The air escape paths 118 of the platen configuration shown in FIG. 3 are a distinct improvement over the non-uniform distribution discussed above in FIG. 2B where non-uniform leakage of fluid beneath the polishing pad 18 provided an uneven polishing surface for the substrate creating hard to control and non-uniform material removal.

Figure 1:
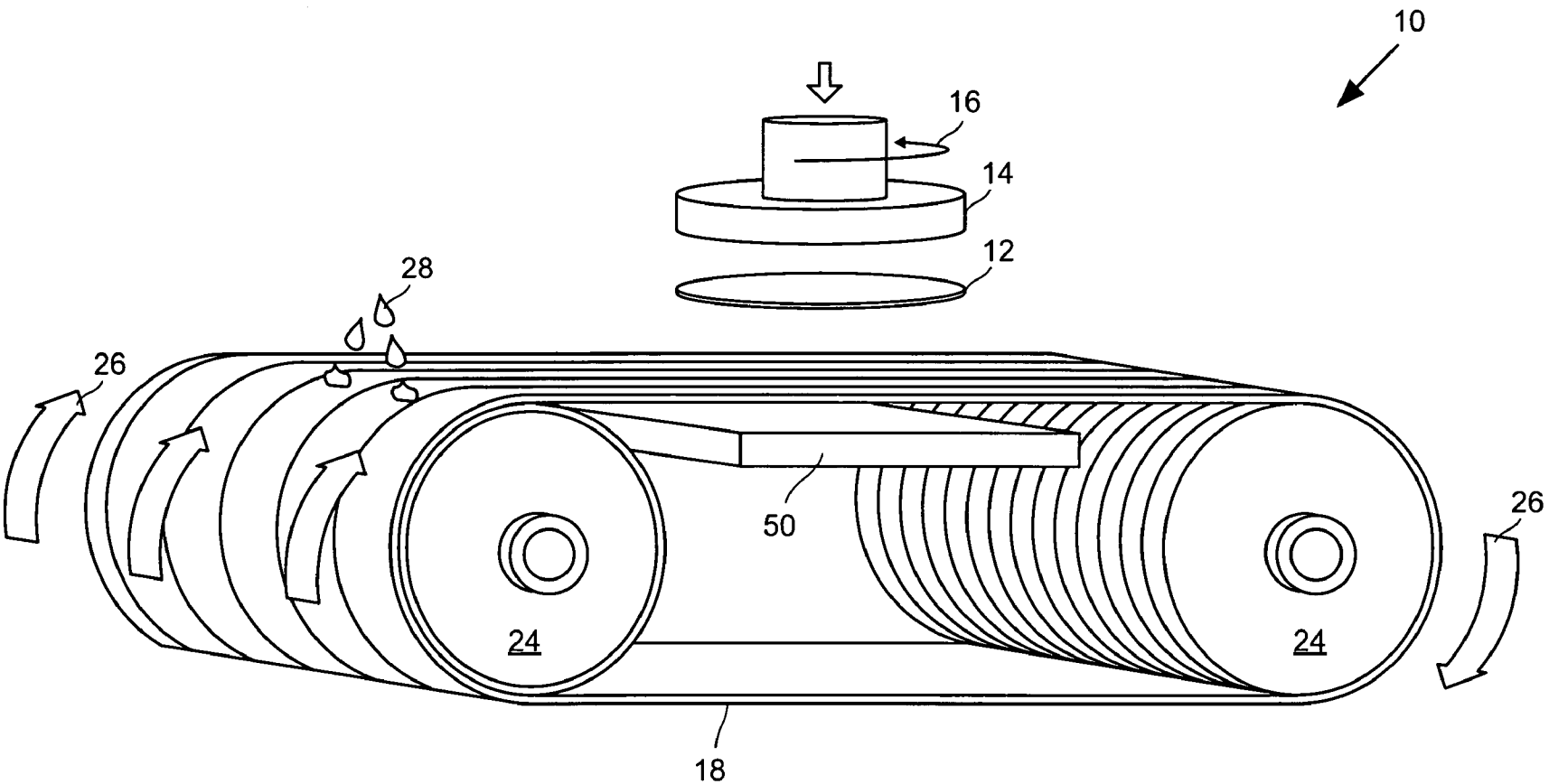
FIG. 1 (Prior Art)
FIG. 1 is a schematic of prior art linear CMP systems.
Figures 2, 4A:
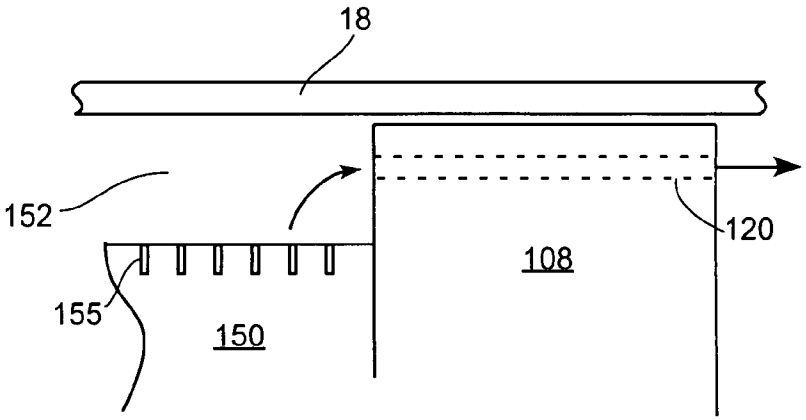
Figures 1, 4A:
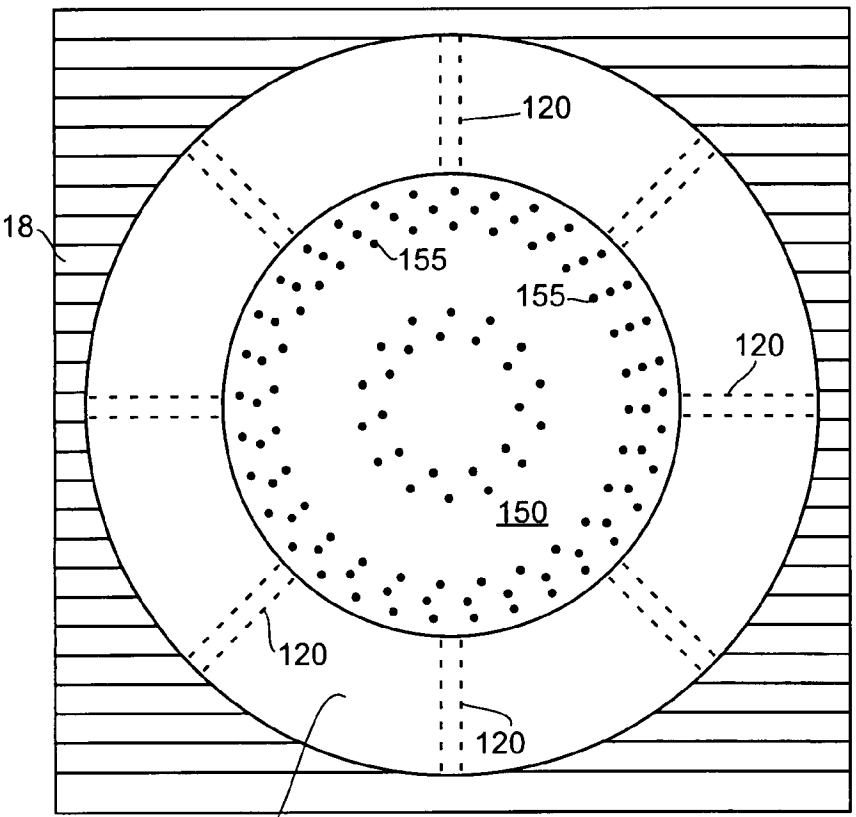
Figures 3, 4A:
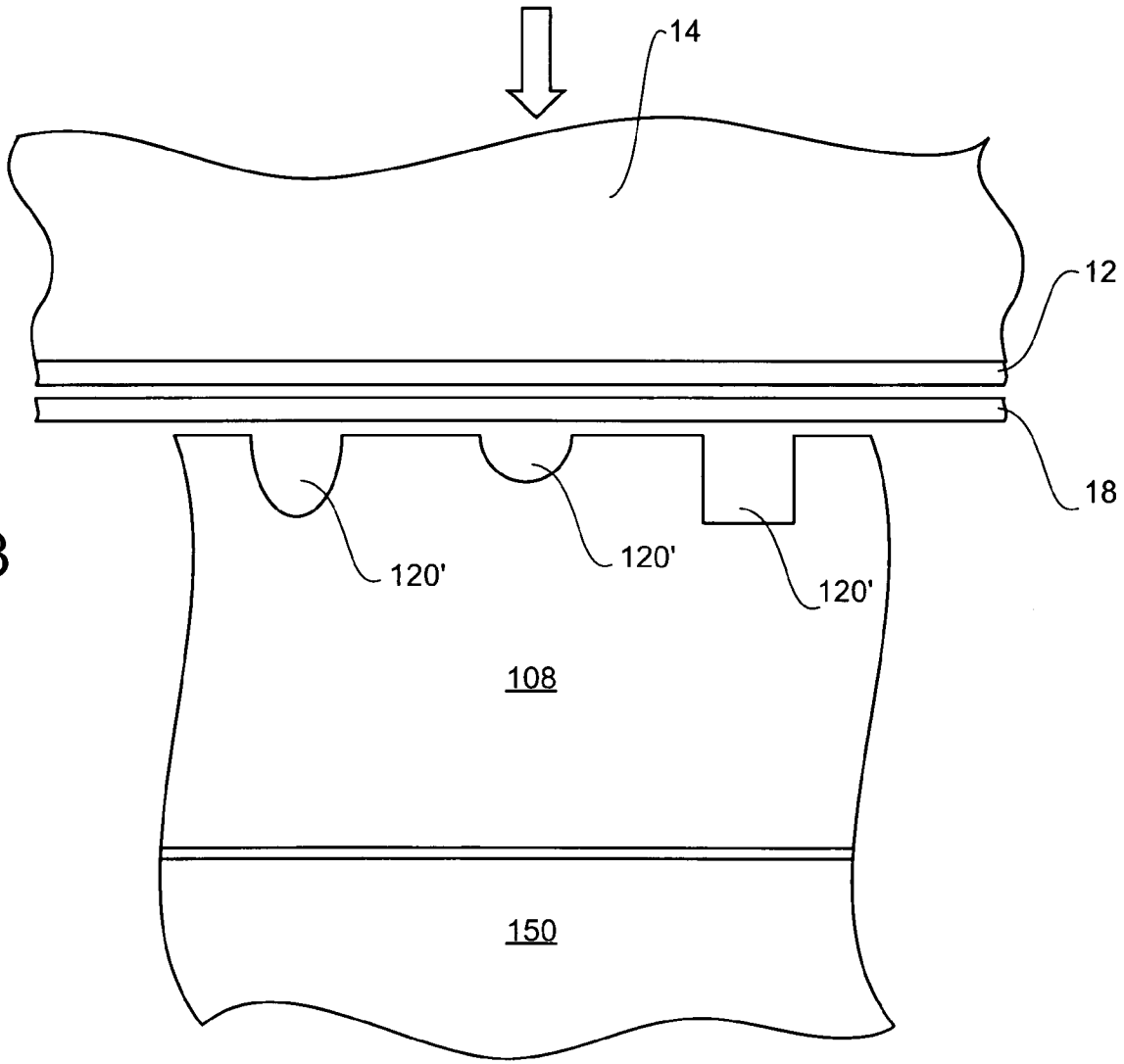

FIG. 4A-1 is an example of an apparatus for use on a chemical mechanical polishing system. A platen 150 is disposed beneath a polishing pad 18 and surrounded by a platen support cover 108. The platen 150 is disposed at a first level and the platen support cover is disposed at a second level, the first level being lower relative to the second level. The platen 150 and the platen support cover 108 are configured to be disposed below the polishing pad 18 such that the polishing pad 18 is closer to the second level than the first level. The first level and second level refer to the height of the platen 150 and the platen support cover 108, respectively relative to the polishing pad 18. The platen 150 is disposed at a level below that of the platen support cover 108 such that the polishing pad 18 is closer to the platen support cover 108 than the platen 150.

As shown in FIG. 4A-2, a recessed region 152 is defined between the platen 150, the platen support cover 108, and beneath the polishing pad 18. This recessed region 152 therefore defines a gap between a surface of the platen 150 and the underside of the polishing pad 18. The platen 150 introduces fluid into the recessed region 152 through a plurality of air inlet holes 155. In accordance with one embodiment, fluid output control paths 120 are defined through the platen support cover 180 at a wall location defined between the height of the platen 150 and the platen support cover 108. The wall height is defined from about 2 to about 100 mils (0.002–0.100 inch).

Returning to FIG. 4A-1, fluid output control paths 120 are replicated a number of times around a periphery of the platen support cover 108. The fluid output control paths 120 may be defined in the platen support cover 108 by drilling, milling, or otherwise forming a hole through the platen support cover 108. Broadly speaking, the fluid output control paths 120 can take on any form, so long as they can define a conduit for controllably removing fluid from within the recessed region 152.

As shown in FIG. 4A-3, the fluid output control paths 120' are not limited to the conduits located on the vertical wall location of the platen support cover 108. The fluid output control paths 120' can be in the form of trenches on top of the platen support cover 108 and underneath the polishing belt 101. In the case of a trench, the applied down force from the carrier head 14 and the substrate 12 on the polishing pad 18 creates at least a partial seal at the lip of the platen support cover 108 thereby controlling the volume of fluid escaping through the fluid output control path 120'. The trench could be defined as a half circular, a half oval, a rectangular or other path defined in the top surface of the platform support cover 108.

Figure 4B:
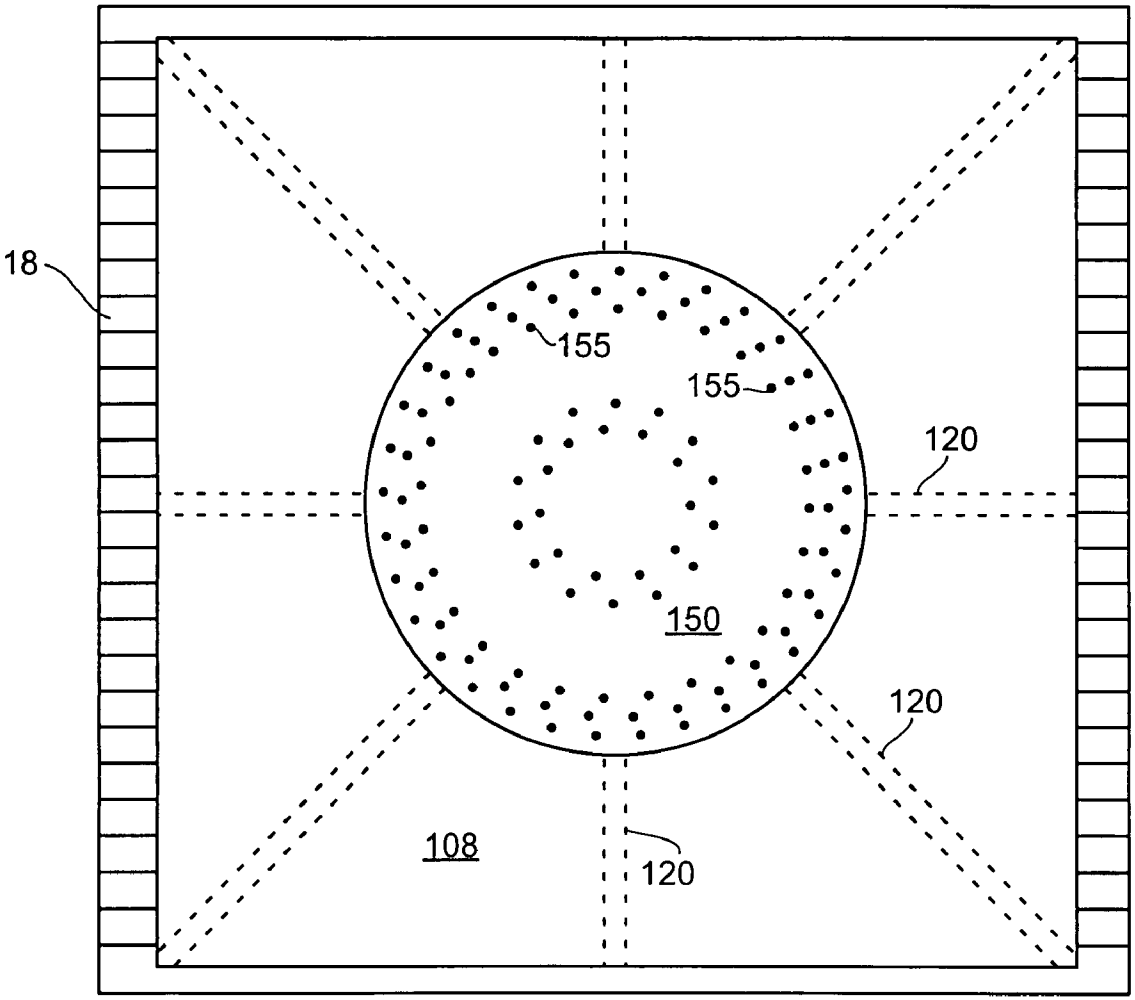
FIG. 4B is a top view diagram of a recessed platen with square support containing fluid output control paths, in accordance with one embodiment of the present invention.

FIG. 4B illustrates a platen support cover 108 having a square shape complete with fluid output control paths 120 at the periphery of the platen 150. The platen support cover 108 surrounds the platen 150 defining a recessed region 152 and a volume filled by fluid supplied by air inlet holes 155.

Figures 2, 4C:
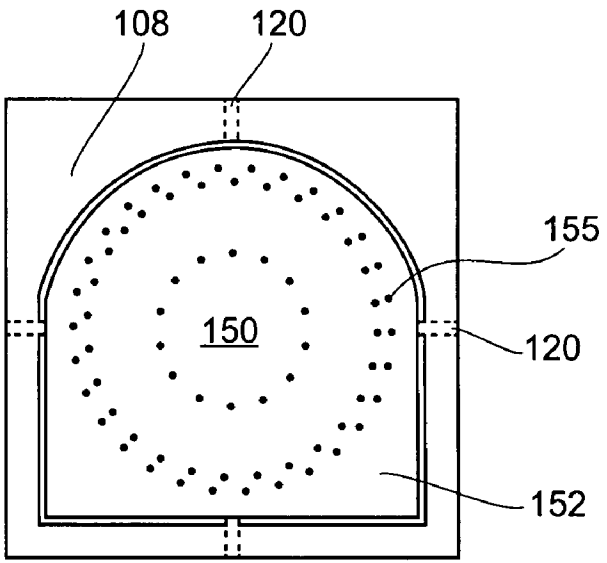
Figures 3, 4C:
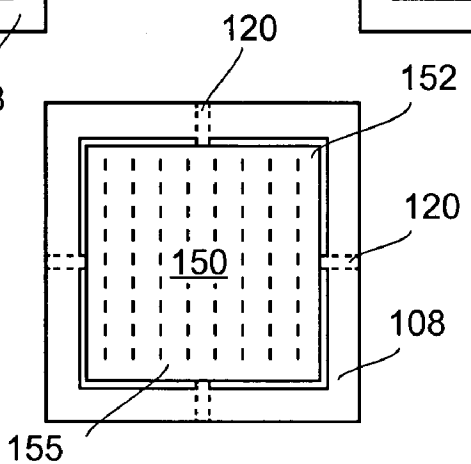
Figures 1, 4C:
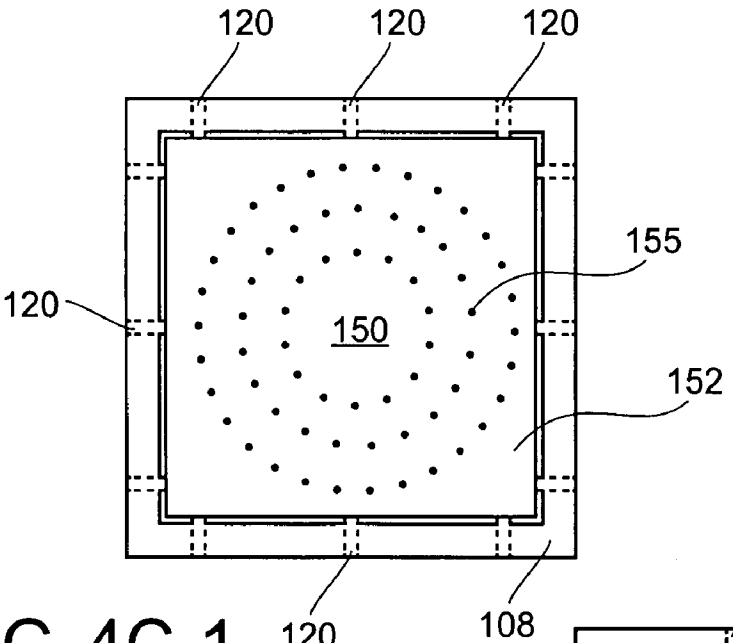

FIG. 4C provides different configurations for the platen support cover 108 surrounding the platen 150 and the recessed region 152 which defines a volume filled by fluid supplied by air inlet holes 155. FIG. 4C-1 shows a platen support cover 108 having a square shape complete with fluid output control paths 120 at the periphery of the platen 150. FIG. 4C-2 shows a platen support cover 108 having a rectangular combined with a half circular shape defining a recessed region 152 above the platen 150. FIG. 4C-2 also provides fluid output control paths 152 at the periphery of the platen 150. FIG. 4C-3 provides a platen support cover 108 having a square shape and defining a recessed region 152 above the platen 150. FIG. 4C-3 provides fluid output control paths 152 at the periphery of the platen 150. As should be understood by the illustrative examples, the geometry of the platen 150 and the platen support cover 108 can take on many different geometries, so long as the fluid output control paths 120 are defined in such a way to controllably release fluid from within the recessed region 152.

Figure 5A:
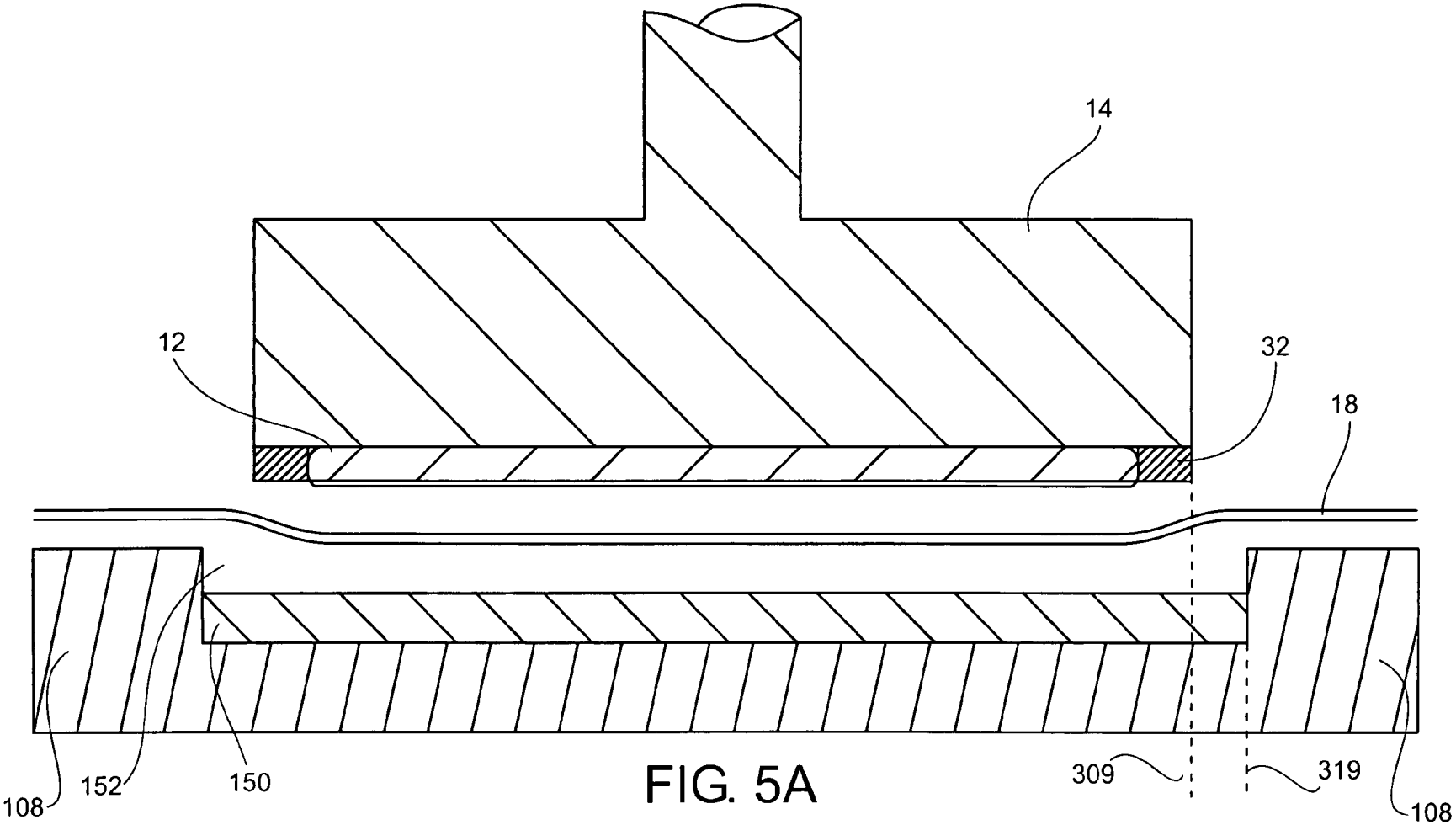
FIG. 5A is a cross sectional diagram of a CMP system having a recessed platen wider than the carrier head and the retaining ring edge, in accordance with one embodiment of the present invention.

FIG. 5A illustrates a CMP system with a carrier head 14 and retaining ring 32 capable of applying a substrate 12 over a polishing pad 18. A platen support cover 108 is disposed below the polishing pad 18 and surrounds the platen 150. A recessed region 152 is defined between the platen 150, the platen support cover 108, and beneath the polishing pad 18. The retaining ring edge 309 as well as the carrier head 14 do not extend beyond the recessed region edge 319 as illustrated in this embodiment. The platen support cover 108 extends to an area beyond the area directly beneath the retaining ring 32 and the carrier head above the platen 150 and the polishing pad 18.

Figure 5B:
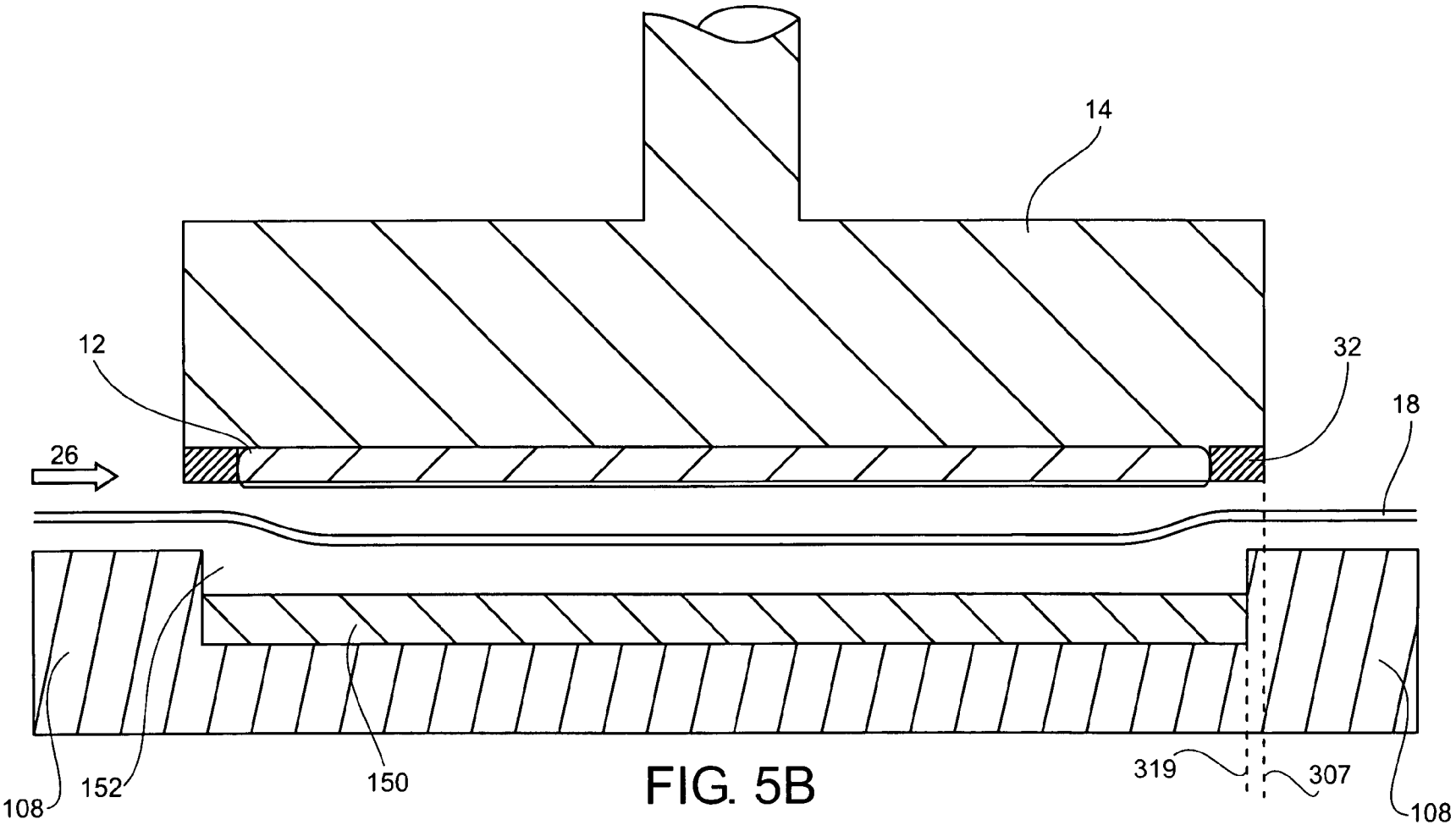
FIG. 5B is a cross sectional diagram of a CMP system having carrier head and the retaining ring edge wider than a recessed platen, in accordance with one embodiment of the present invention.

FIG. 5B illustrates another embodiment of a CMP system having a carrier head 14 and retaining ring 32 capable of applying a substrate 12 over a polishing pad 18. A platen support cover 108 is disposed below the polishing pad 18 and surrounds the platen 150. A recessed region 152 is defined between the platen 150, the platen support cover 108, and beneath the polishing pad 18. The retaining ring edge 307 as well as the carrier head 14 extend beyond the recessed region edge 319. The platen support cover 108 has area directly beneath the retaining ring 32 and a carrier head 14 positioned above the platen 150 and the polishing pad 18. The retaining ring 32 extending beyond the recessed region edge 319 restricts pressure in the area above the platen 150 and below the polishing pad 18. However, the fluid output control paths 120 can be used to enable controlled release of the fluid from within the recessed region 152. The retaining ring 32 also provides protection to the edge of the substrate 12 which may otherwise encounter edge burn as portions of the polishing pad 18 move downward approaching the recessed region 152 and upward as portions of the polishing pad 18 pass through the recessed region in the rotational direction 26.

Figure 6:
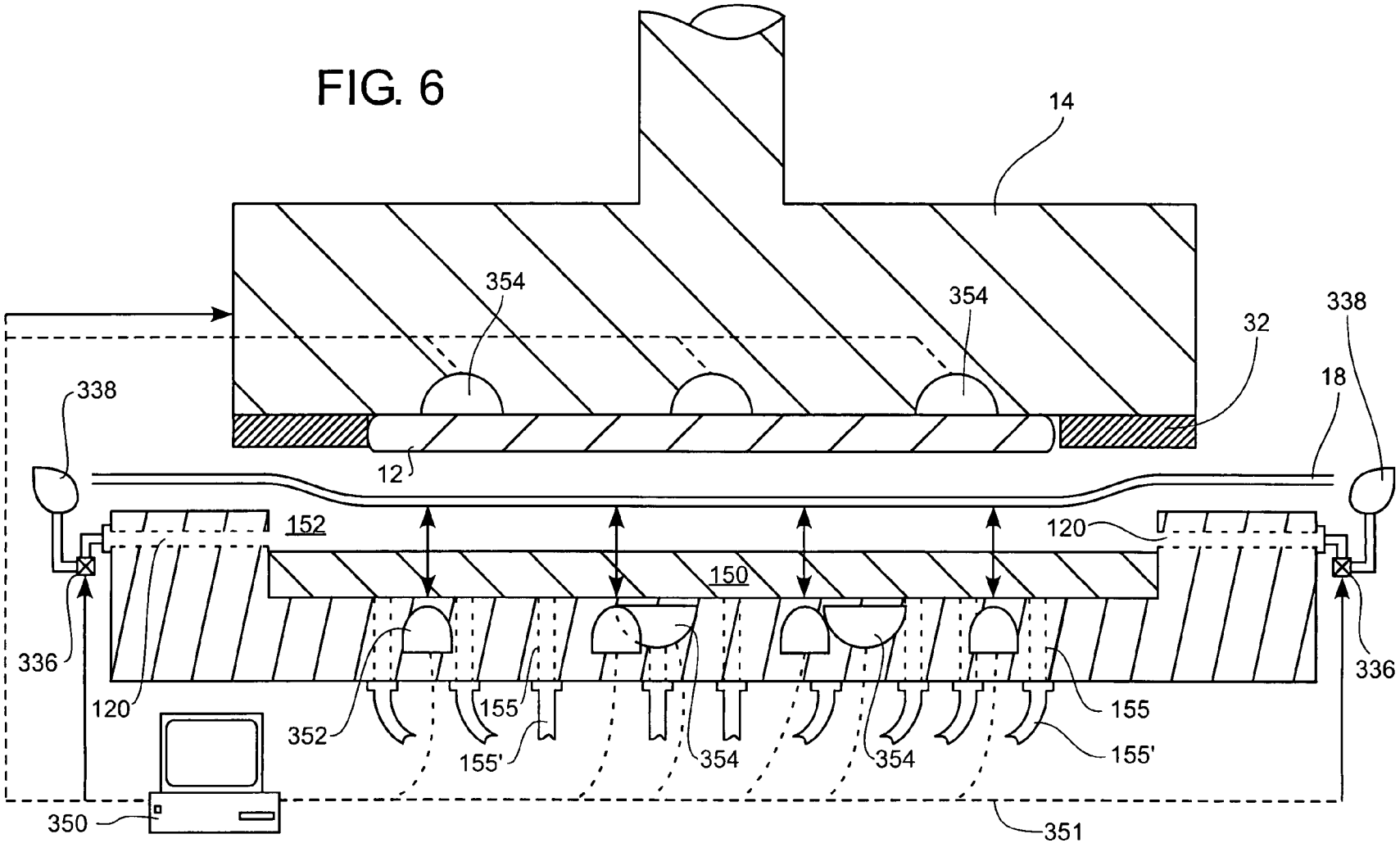
FIG. 6 is a cross sectional diagram of a CMP system that provides sensor feedback for a system of fluid output control paths, in accordance with one embodiment of the present invention.

FIG. 6 is a cross sectional diagram of a CMP system incorporating feedback and control for active monitoring and pressure regulation of the recessed area beneath the polishing pad. As discussed above, a carrier head 14 and a retaining ring 32 capable of receiving a substrate 12 may be positioned over a polishing pad 18, a platen 150, and a platen support cover 108. The retaining ring 32 may extend beyond the recessed region 152 restricting pressure in the area above the platen 150 and below the polishing pad 18 providing protection to the substrate 12 as described in FIG. 5B above.

Typically down force of the carrier head 14 containing the substrate 12 is carefully monitored as a substrate is processed.

Fluid is supplied from facilities through air conduits 155' and air inlet holes 155 in the platen 150 in order to support the polishing pad 18 passing beneath the substrate 12. In operation, fluid supplied through the air inlet holes 155 in the platen 150 creates a volume of fluid in the recessed region 152 between the first level of the platen 150, the second level of the platen support cover 108, and below the polishing pad 18 that supports the polishing pad 18. Pressure beneath the polishing pad 18 provides counteracting force to the substrate 12 against the down force applied by the carrier head 12. Fluid output control paths 120 located around the periphery of the platen 150 enable controlled release of fluid contained in the recessed region 152 between the platen 150, the platen support cover 108, and beneath the polishing pad 18. The volume of fluid escaping each fluid output control path 120 can be regulated by one of a series of valves 336.

Monitoring and control of pressure beneath the polishing pad 18 may be attained by a unit including various software and hardware components. A monitoring and control unit may incorporate the use of algorithms for precise control of pressure beneath the polishing pad 18. Mechanisms capable of controlling the fluid output control paths may have various structures such as valves that are controlled mechanically, electronically, or controlled manually by an operator. Broadly speaking structures such as hoses and conduits may be utilized to enable valves to adjust release of fluid from the recessed region 152 above the platen 150.

Returning to FIG. 6, distance sensors 352 are capable of measuring the height of the polishing pad above the platen 150. Distance sensors 352 may be in communication 351 with a computer 350 capable of receiving and processing the input from the distance sensors 352 and other sensors associated with the apparatus. A computer 350 in communication 351 with the valves 336 monitors distance sensors 352 and other sensors 354 on the apparatus in order to provide desired pressure in the recessed region 152 below the polishing pad 18. When the computer 350 determines that distance sensors 352 indicate that the polishing pad 18 height is too high above the platen 150, fluid contained in the recessed region 152 is capable of being released via valves 336 to facilities 338.

Additional sensors 354 may be equipped on the carrier head 14, in the platen 150 and platen support cover 108 in order to provide in-situ feedback regarding the processing of the substrate 12. The sensors 354 can take on any number of forms so long as the device provides appropriate feedback for the state of the polishing operation enabling a measure of process control. The sensors 354 may be one of a laser sensor, a heat sensor, a pressure sensor and a polishing rate removal sensor that provide feedback on the progress of the polishing process. A pressure transducer can be used to monitor the cavity pressure under the polishing pad 18. In one embodiment, sensors 354, such as eddy current sensors, may indicate that thickness in particular areas of the substrate are non-uniform, thus prompting the computer to make adjustments to the down force of carrier head 14 or the volume of fluid in the recessed region 152 by controlled release of fluid through the valves 336. For more explanation on the use of eddy current sensors see pending U.S. patent application Ser. No. 10/186,472, entitled "INTEGRATION OF EDDY CURRENT SENSOR BASED METROLOGY WITH SEMICONDUCTOR FABRICATION TOOLS," filed on Jun. 28, 2002 which is incorporated herein by reference. Because the valves 336, in one embodiment, may be located around the entire periphery of the platen 150, localized control over the volume of fluid beneath the polishing pad 18 can provide varying realized down force in particular regions beneath the substrate 12.

Information obtained by the computer 350 over the course of processing can be used to tailor processing techniques used on subsequent substrates. Processing recipes may be developed based on substrate structures as well as known biases of the equipment in operation. Adjustment of controlled release of fluid in localized areas beneath the polishing pad 18 can assist in the achievement of desired results, namely uniform application of the removal rates and uniform thickness of material remaining after the planarization process.

Figure 7:
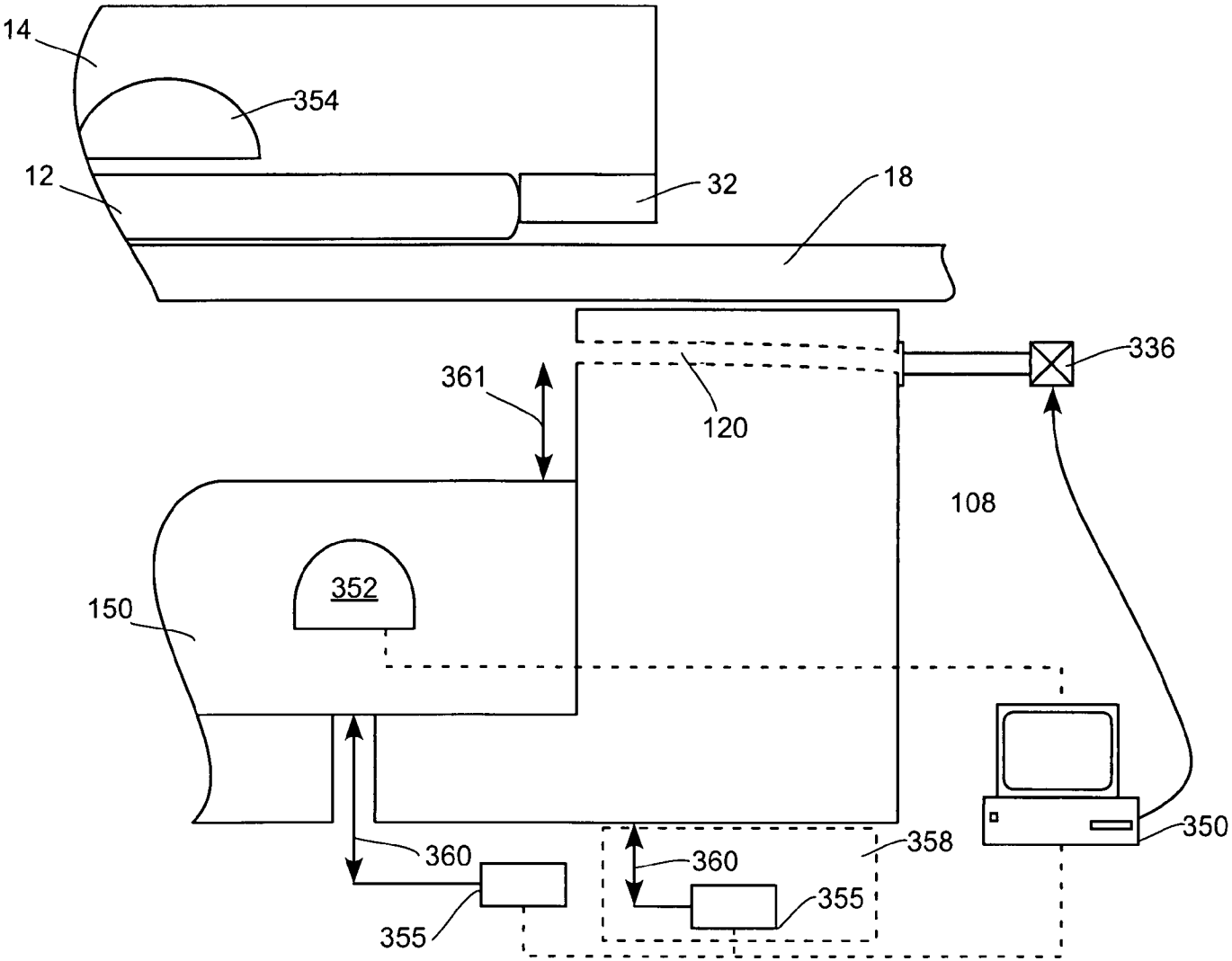
FIG. 7 is a cross sectional diagram of a CMP system shows vertical movement of the platen and or the platen support cover, in accordance with one embodiment of the present invention.

FIG. 7 is a cross section of a CMP system, in accordance with another embodiment, which provides for vertical movement of the platen 150 and the platen support cover 108. In addition to control of fluid beneath the polishing pad 18 described in FIG. 6 above, the height of the platen 150 and the height of the platen support cover 108 are capable of independent adjustment. A computer 350 capable of receiving input from distance sensors 352 as well as sensors 354, such as eddy current sensors, may direct vertical movement of the platen 150 and the platen support cover 108 in order to provide desired conditions for the processing of a substrate 12. A distance that defines a gap between the top of the platen and the fluid output control paths 361 is capable of being changed by an adjuster 355 that provides vertical movement 360 of the platen 150. Feedback from the distance sensors 352 ensure that the adjuster 355 drives the platen 150 to the desired height which may be a set-point. As an optional control 358, a second adjuster 355' can provide vertical movement 360' of the platen support cover 108. Adjustment of the platen height may be desirable for different applications. For instance, in situations where the outer part of a substrate is polished at a removal rate that is less than that experienced in the center, the distance which may be described as a gap between the top of the platen and the fluid output control paths 361 may be made greater so that the polishing pad 18 passing above may have greater resistance toward the edge of the platen. It should be noted that elevation of the platen 150 above the level of the fluid output control path 120 could be controlled by the computer 350 so that the platen 150 does not obscure the ability to controllably release fluid from the recessed region 152.

Figure 8:
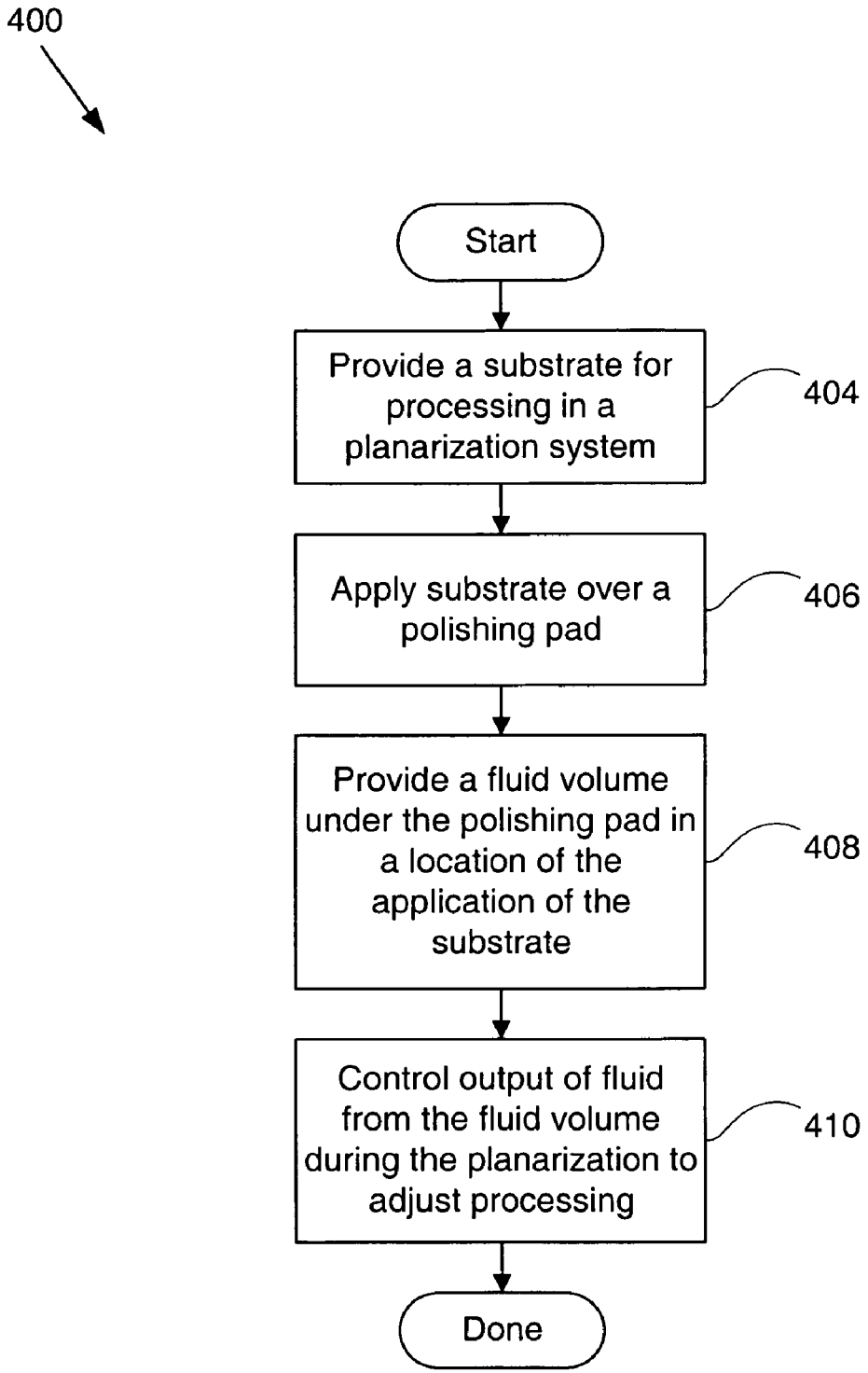
FIG. 8 is a flow chart of the method of applying control to the output of fluid from the fluid volume during planarization, in accordance with one embodiment of the present invention.

FIG. 8 illustrates a method for controlling pressure beneath a polishing pad 400. The method begins by providing a substrate for processing in a planarization system in operation 404. The substrate may be a semiconductor wafer, a flat panel display, or other workpiece. Next the substrate is applied over a polishing pad in operation 406. The polishing pad may be operated in a linear, rotary, or reciprocating fashion such that friction is applied to the substrate for the purpose of removing material, planarizing, or polishing. A volume of fluid is then provided under the polishing pad in a location of the application of the substrate in operation 408. The volume of fluid provides support to the backside of the polishing pad as it is applied to the substrate, creating a fluid bearing. Next control over the output of fluid from the fluid volume during the planarization allows for adjustment of the processing in operation 410. When desired characteristics of the process are attained and the substrate is sufficiently polished the method is complete.

Figure 9:
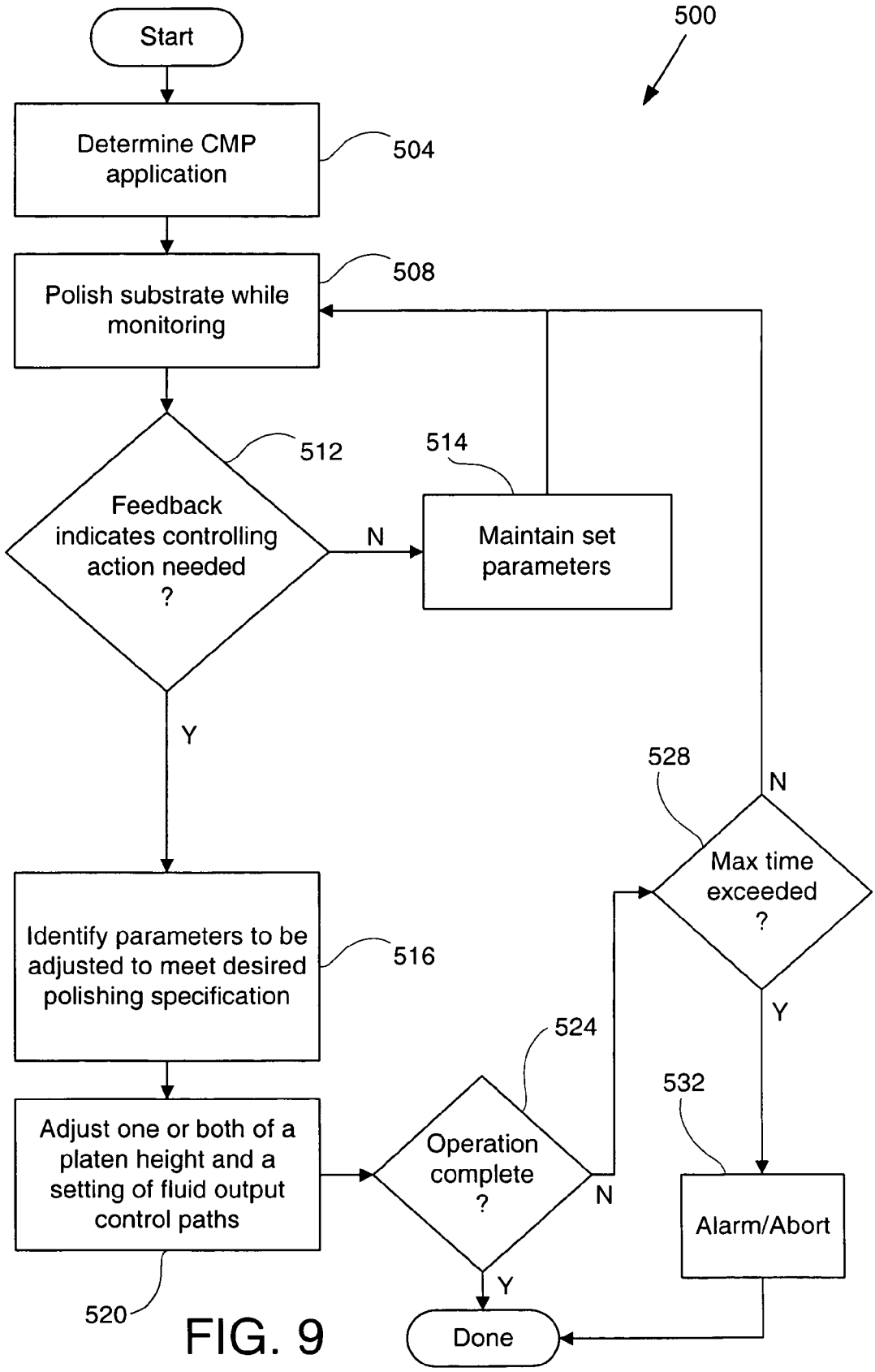
FIG. 9 is a flow chart of active process control by adjusting platen height and platen fluid output, in accordance with one embodiment of the present invention.

FIG. 9 is a flow chart of another method for in-situ monitoring and process control of a substrate undergoing Chemical Mechanical Polishing CMP 500. In operation 504 the particular CMP application is determined. The application may be defined as one of a removal of a particular film or material. Next the substrate is polished while being monitored in operation 508. Input parameters such as platen pressure, and belt-platen distance are monitored during operation of the CMP system. Feedback indicating whether controlling actions are needed is provided to a computer in operation 512. If feedback indicates that no corrective and controlling action is required the polishing continues while maintaining the set parameters in operation 514 and returning to the method of operation 508. If, however, feedback indicates that controlling action is needed, parameters requiring adjustment in order to meet the desired polishing specifications are determined by the computer in operation 516. Adjustment of one or both of the platen height and fluid output control paths at designated locations on the periphery of the platen is affected in operation 520. For example, when a pressure drop in the platen cavity is detected, the controller automatically increases the input pressure until reaches its target set point. The controller may utilize one of several methods to determine the amount of correction needed. These methods include run-to-run comparisons and control, as well as the use of neural-networks and other mathematical algorithms that provide a measure of process control. If the corrective action taken in operation 520 completes the planarization application through attainment of the required specification, the process is complete in operation 524. The polishing operation may be governed by a maximum processing time in operation 528. When the deviation from the desired specification is still present beyond an allowable control time, an alarm will be activated, in operation 532. If the required specification has not been attained and a given time limit has not been exceeded the method proceeds to operation 508 thereby continuing to polish the substrate while monitoring. The method will continue with operations 512, 516 and 520 until the desired specifications are obtained completing the process in operation 524 or the unless the process is aborted by other events such as a system timeout, endpoint determination, equipment failure or manual abort.

The invention has been described herein in terms of several exemplary embodiments. The above described embodiments may be applied to rotary or orbital type CMP systems as well as linear CMP systems that rely upon belt type polishing media. Other embodiments of the invention will be apparent to those skilled in the art from consideration of the specification and practice of the invention. The embodiments and preferred features described above should be considered exemplary, with the invention being defined by the appended claims.

What is claimed is:

1. An apparatus for use in a chemical mechanical planarization (CMP) system, comprising:

a platen capable of introducing fluid beneath a polishing pad; and a platen support cover configured to surround the platen, the platen being disposed at a first level and the platen support cover being disposed at a second level, the first level being lower relative to the second level, the platen and the platen support cover configured to be disposed below the polishing pad such that the polishing pad is closer to the second level than the first level the platen support cover having a width at the second level, the width being substantially equal around the platen;

wherein at least one fluid output control path is defined within the platen support cover at a wall location defined between the first level and the second level.

2. The apparatus of claim 1, wherein the width being substantially equal is one of a circular shape platen support cover that enables substantially uniform distribution of fluid pressure escaping between the platen support cover and the polishing pad.

3. The apparatus of claim 1, wherein a recessed region is defined between the platen, the platen support cover, and beneath the polishing pad.

4. The apparatus of claim 3, wherein the platen introduces fluid into the recessed region.

5. The apparatus of claim 1, wherein a substrate is capable of being applied over the polishing pad and over the platen.

6. The apparatus of claim 4, the at least one fluid output control path enabling controlled release of fluid contained over the platen, surrounded by the platen support cover, and beneath the polishing pad.

7. The apparatus of claim 4, wherein at least one fluid output control path is defined through the platen support cover at a location on the surface of the second level, the at least one fluid output control path enabling controlled release of fluid contained over the platen, surrounded by the platen support cover, and beneath the polishing pad.

8. The apparatus of claim 1, wherein the first level and the second level is relative to a vertical distance from the polishing pad.

9. The apparatus of claim 6, wherein the at least one fluid output control path is replicated a number of times around a periphery of the platen support cover.

10. An apparatus for use in a chemical mechanical planarization (CMP) system, comprising:

a platen;

a platen support cover configured to surround the platen, the platen being disposed at a first level and the platen support cover being disposed at a second level, the first level being lower relative to the second level, the platen and the platen support cover configured to be disposed below a polishing pad such that the polishing pad is closer to the second level than the first level; and at least one fluid output control path defined within the platen support cover, the at least one fluid output control path enabling controlled release of fluid contained over the platen, surrounded by the platen support cover, and beneath the polishing pad.

11. The apparatus of claim 10, wherein the at least one fluid output control path is defined through the platen support cover at a wall location defined between the first level and the second level.

12. The apparatus of claim 10, wherein the at least one fluid output control path is defined on the surface of the platen support cover on the second level.

13. The apparatus of claim 10, wherein a recessed region is defined between the platen, the platen support cover, and beneath the polishing pad.

14. The apparatus of claim 10, wherein the platen introduces fluid into the recessed region.

15. The apparatus of claim 10, wherein a substrate is capable of being applied over the polishing pad and over the platen.

16. The apparatus of claim 10, wherein the platen support cover is one of a circular, half circular, rectangular, octagonal, hexagonal, and oval shape that provides uniform distribution of fluid pressure escaping beneath the polishing pad.

17. The apparatus of claim 10, wherein the first level and the second level is relative to a vertical distance from the polishing pad.

18. The apparatus of claim 10, wherein the at least one fluid output control path is replicated a number of times around a periphery of the platen support cover.

19. The apparatus of claim 10, wherein the platen support cover extends to an area beyond the area directly beneath a retaining ring of a carrier head configured to be positioned above the platen and the polishing pad.

20. The apparatus of claim 19, wherein the platen support cover has area directly beneath a retaining ring of a carrier head configured to be positioned above the platen and the polishing pad.

21. The apparatus of claim 13, wherein a retaining ring restricts pressure in the recessed region above the platen and below the polishing pad.

* * * * *